US005225319A

United States Patent [19]

Fukazawa et al.

[11] Patent Number: 5,225,319

[45] Date of Patent: Jul. 6, 1993

[54] LIGHT-SENSITIVE SILVER HALIDE PHOTOGRAPHIC MATERIAL

[75] Inventors: Fumie Fukazawa; Hiroshi Takada, both of Hino, Japan

[73] Assignee: Konica Corporation, Tokyo, Japan

[21] Appl. No.: 788,206

[22] Filed: Nov. 5, 1991

[30] Foreign Application Priority Data

Nov. 7, 1990 [JP] Japan ..... 2-301362

[51] Int. Cl.[5] ..... G03C 1/795; G03C 1/015

[52] U.S. Cl. ..... 430/533; 430/567; 430/569

[58] Field of Search ..... 430/533, 569, 567

[56] References Cited

U.S. PATENT DOCUMENTS 4,879,208 11/1989 Urabe ..... 430/569

FOREIGN PATENT DOCUMENTS 0334367 9/1989 European Pat. Off. ..... 430/533
326852 8/9189 European Pat. Off. .
1472745 2/1972 Fed. Rep. of Germany .

*Primary Examiner*—Charles L. Bowers, Jr.
*Assistant Examiner*—Mark F. Huff
*Attorney, Agent, or Firm*—Jordan B. Bierman

[57] ABSTRACT

Disclosed is a light-sensitive silver halide photographic material having at least one layer containing a silver halide emulsion on a support, wherein at least one layer containing said silver halide emulsion contains a silver halide emulsion having at least partially silver halide grains formed by the fine grain feeding method, and said support has a thickness of 25 μm to 120 μm.

12 Claims, No Drawings

LIGHT-SENSITIVE SILVER HALIDE PHOTOGRAPHIC MATERIAL

BACKGROUND OF THE INVENTION

This invention relates to a light-sensitive silver halide photographic material, more particularly to a light-sensitive silver halide photographic material which is made to have a small format and reduced fog or white drop-out.

In recent years, uses of light-sensitive silver halide photographic materials have been diversified. For example, conveying of the film during photographing has been made higher in speed, photographing magnification increased, and also the size of photographing device has progressed to be made remarkably smaller, and therefore light-sensitive materials which can correspond to these parameters have been demanded. In order to comply with such circumstances, there have been of light-sensitive materials using a thin support. For example, Japanese Unexamined Patent Publication No. 89045/1990, No. 181749/1990, No. 214852/1990, etc. describe a light-sensitive material to be housed in a small vessel.

However, when such light-sensitive materials using thin supports is housed in a small vessel, it will cause a new problem that the local density of image is increased or lowered, and therefore its improvement has been desired.

Accordingly, the present invention has been accomplished in order to solve the above problem, and an object of the present invention is to provide a light-sensitive silver halide photographic material which can be made smaller in size by use of a thin support, and local fluctuation of image density can be suppressed.

SUMMARY OF THE INVENTION

The above object of the present invention can be accomplished by a light-sensitive silver halide photographic material having at least one layer containing a silver halide emulsion on a support, wherein at least one layer containing said silver halide emulsion contains a silver halide emulsion having at least partially silver halide grains formed by the fine grain feeding method, and said support has a thickness of 25 μm to 120 μm.

DETAILED DESCRIPTION OF THE INVENTION

The support to be used in the present invention is not particularly limited, provided that the thickness of the support is within the range of 25 μm to 120 μm in order to stand conveying tension in wind-up after photographing and developing processing, but in order to make the packaging unit lighter and smaller, the thickness of the support should be desirably as thin as possible.

In cellulose triacetate type supports, if the thickness of the support is too thin, particularly 25 μm or less, it cannot sometimes stand conveying tension, and is also susceptible to formation of wrinkles, and therefore the thickness of the support may be preferably 25 μm to 100 μm, further particularly preferably 50 μm to 100 μm. On the other hand, in polyethylene terephthalate (PET) type supports, the thickness may be preferably made 25 μm to 70 μm. Also, in PET type supports, only if flaws are provided at the perforation holes which are cleaved off only when excessive force acts on the perforation holes, breaking of delivery gear cogs on the camera side can be prevented.

In the present invention, it is preferable to use a film comprising cellulose ester (particularly cellulose triacetate, cellulose diacetate, cellulose propionate), polyamide, polycarbonate, polyester (particularly polyethylene terephthalate, poly-1,4-cyclohexanedimethylene terephthalate, polyethylene-1,2-diphenoxyethane-4,4'-dicarboxylate), polystyrene, polypropylene, polyethylene, etc. as the support. Further, those mentioned in RD No. 17643 on page 28, and the same No. 18716 on page 647, right col. to page 648, left col. can be also used. Among these, with respect to stability, toughness, etc., polyethylene terephthalate film, particularly biaxially stretched, thermally fixed polyethylene terephthalate film is preferable for easy handleability, and cellulose triacetate (TAC) is particularly preferably used. TAC may be preferably one produced according to the preparation method as described in, for example, Japanese Unexamined Patent Publication No. 115035/1987.

In the present invention, of polyester films, a polyester film with a haze of 3% or lower and a water content of 0.5% by weight or more is preferably used. More preferably, a polyester film with a water content in the range of 0.6 to 5.0% by weight is used. If the water content is less than 0.5% by weight, wind-up curling propensity after developing processing cannot be made better, while on the contrary if the water content is too large, dimensional stability will be worsened readily by moisture absorption.

Measurement of the water content of a polyester film is done by controlling the humidity of said film under the conditions of 23° C., 30% RH, 3 hours, then dipping the film in distilled water of 23° C. for 15 minutes, and then measuring the water content at a dry temperature of 150° C. by use of a minute amount water meter (e.g. CA-02 Model produced by Mitsubishi Kasei K. K.).

The haze of a polyester film is measured according to ASTM-D1003-52.

The polyester to be used in the present invention is a polyester comprising an aromatic dibasic acid and a glycol as the main constituent components, and representative dibasic acids may include terephthalic acid, isophthalic acid, and examples of glycol may include ethylene glycol, propylene glycol, butandiol, neopentyl glycol, 1,4-cyclohexane diol, diethylene glycol, etc. Among the polyesters comprising these components, polyethylene terephthalate (PET) is the most preferable from the standpoint of easy availability, and therefore in the following description is made by use of PET.

The copolymerized polyethylene terephthalate film to be preferably used in the present invention comprises a copolymerized polyethylene terephthalate film having an aromatic dicarboxylic acid component having a metal sulfonate as the copolymerization component.

Specific examples of the above aromatic dicarboxylic acid having a metal sulfonate may include 5-sodium sulfoisophthalic acid, 2-sodium sulfoterephthalic acid, 4-sodium sulfophthalic acid, 4-sodium sulfo-2,6-naphthalenedicarboxylic acid and compounds with these sodiums substituted with other metals such as potassium, lithium, etc. The copolymerization ratio of the aromatic dicarboxylic acid component having a metal sulfonate may be preferably 2 to 15 mole %, particularly preferably 4 to 10 mole % based on the terephthalic acid component which is the main starting material.

In the copolymerized polyethylene terephthalate film to be used in the present invention, it is further preferable for transparency, particularly from aspects of inhibition of whitening of the copolymerized polyethylene terephthalate film surface and flex resistance that an aliphatic dicarboxylic acid component having 4 to 20 carbon atoms may be copolymerized.

Specific examples of the aliphatic dicarboxylic acid component having 4 to 20 carbon atoms can include succinic acid, adipic acid, sebacic acid, etc., but among them adipic acid is preferable. The copolymerization ratio of the aliphatic dicarboxylic acid component having 4 to 20 carbon atoms may be preferably 3 to 25 mole %, particularly 5 to 20 mole % based on the terephthalic acid component.

In the polyester film to be used in the present invention, within the range which does not impair transparency, and mechanical characteristics, still other acid components or glycolic components can be also copolymerized. For example, polyalkylene glycol, particularly polyethylene glycol can be copolymerized at a ratio of 0 to 10% by weight. The polyalkylene glycol which is used for such purpose should preferably have a molecular weight within the range of 600 to 10,000.

One of the properties causing problems in the use of polyester film as the support for a light-sensitive photographic material is the brim fog generated because the support has a high refractive index.

The refractive index of PET is about 1.6, while the refractive index of gelatin used exclusively in subbing layer and photographic emulsion layers is 1.50 to 1.55, and therefore when the ratio of refractive index of gelatin and PET is taken, it becomes smaller than 1, that is, 1.5/1.6, whereby reflection is liable to occur at the interface of the base and emulsion layer when a light enters through a film edge. Therefore, a polyester type film is liable to cause light piping phenomenon (brim fog) to occur.

In the present invention, in order to avoid such light piping phenomenon, a dye which will not increase film haze is added. The dye to be used is not particularly limited, but in general properties of the light-sensitive material, a dye having gray tone is preferable, and also one which is excellent in heat resistance in the film forming temperature region of polyester film and also excellent in compatibility with polyester is preferred. As specific dyes, from the above standpoint, Diaresin produced by Mitsubishi Kasei, Kayaset produced by Nippon Kayaku, etc. may be employed. Also, the dying density is required to be at least 0.01 or higher as the measured value by the color densitometer produced by Macbeth, preferably 0.03 or more.

To the above polyester film, it is also possible to impart ready lubricity depending on the use. The means for imparting ready lubricity is not particularly limited, but kneading of an inert inorganic compound, or coating of a surfactant, etc. may be employed as the general methods. Also, it is possible to use the method with internal grains which precipitate the catalyst, etc. to be added during polyester polymerization reaction.

As the above inert inorganic compound, $SiO_2$, $TiO_2$, $BaSO_4$, $CaCO_3$, talc, kaolin, etc. may be included. Since transparency is an important requirement as the support for a light-sensitive photographic material, it is desirable to select $SiO_2$ having a refractive index relatively approximate to polyester film, or an internal grain system which can make the grain size precipitated relatively smaller.

When ready lubricity is imparted by kneading, there is also employed the method in which a layer imparted with a function is laminated in order to give more film transparency. Specifically, a co-extrusion method by a plural number of extruders and feed blocks, or multi-manifold dye may be employed.

Depending on the copolymerization ratio, there may sometimes ensue the problem that low polymerized product is precipitated by the heat treatment during provision of subbing layer. In such case, it can be solved by laminating conventional polyester layers on at least one surface of said support, and also in that case, a co-extrusion method may be used as the effective means.

The starting polymer for the copolymerized polyethylene terephthalate film can be synthesized according to the preparation method of polyester known in the art. For example, the acid component can be subjected to a direct esterification reaction with the glycolic component, or when dialkyl ester is employed as the acid component, first interesterification reaction can be carried out with the glycolic component, which is then heated under reduced pressure to remove exccessive glycolic component to give the copolymerized polyethylene terephthalate. In this case, if necessary, an interesterification reaction catalyst or a polymerization reaction catalyst can be used, or a heat-resistance stabilizer can be added.

The copolymerized polyethylene terephthalate obtained is generally molded into particulate shape, and after drying, melt extruded into an unstretched sheet, which is then molded into a film by biaxial stretching and heat treatment.

Biaxial stretching may be effected either in successive longitudinal and lateral stretching or biaxial simultaneous stretching, and the stretching degree is not particularly limited, but generally 2.0 to 5.0-fold is suitable. Also, after longitudinal, lateral stretching, re-stretching may be also effected in either longitudinal, lateral direction.

As the drying method, before melt extrusion, the vacuum drying method or the dehumidifying drying method are preferable.

The temperature during stretching may be desirably 70° to 100° C. for longitudinal stretching, and 80° to 160° C. for lateral stretching.

The thermal fixing temperature may be preferably 150° to 210° C., particularly 160° to 200° C.

The thickness of the copolymerized polyethylene terephthalate film can be suitably set depending on the use field of the photographic film, but may be preferably 25 to 70 μm, further 40 to 70 μm, particularly 50 to 70 μm.

In the present invention, at least one layer of silver halide emulsion layers contains a silver halide emulsion containing silver halide grains shown below. That is, in the present invention, it is required that a part or all of said silver halide grains should be formed according to the fine grain feeding method, and it is preferable that 10% or more of said particles should be formed by the fine grain feeding method, more preferably 20% or more, further preferably 40% or more, particularly preferably 60% or more.

The fine grain feeding method as herein mentioned refers to the method which forms silver halide grains by feeding silver halide grains with fine sizes, into a reactor, and there may be included the method in which only silver halide fine grains are fed, and the method in which feeding of an aqueous solution of a halide salt or silver salt accompanied as described in Japanese Unexamined Patent Publication No. 167537/1990. For enhancing more uniformity of silver halide grains, it is preferable to use the method in which only silver halide fine grains are fed.

The silver halide grains with fine sizes to be fed (hereinafter sometimes also referred to silver halide fine grain) should have grain sizes of 0.1 μm or less, more preferably 0.05 μm or less, particularly preferably 0.03 μm or less. The grain size of silver halide fine grains can be determined from the diameter of the grain in an electron microscope photograph with a magnification of ×30,000 to 60,000, or by measuring the area during projection and calculating as a circle.

For feeding silver halide grains, they can be fed immediately after formation of the fine grains in a mixer for preparation of fine grain emulsion, or accumulated fine grains after fine grain formation can be also fed, and in the present invention, the latter is preferable. When those accumulated after formation are fed, they can be fed in parallel to formation of light-sensitive silver halide grains, or they can be also prepared prior to formation of light-sensitive silver halide grains.

In the present invention, for forming silver halide grains, one kind of silver halide fine grains having a halide composition depending on the purpose can be also fed, or by use of two or more kinds of silver halide fine grains having different silver halide compositions, and adjusting the mixing ratio, they can be also fed simultaneously or separately. That is, for forming silver halide grains having a desired silver iodide content, silver halide fine grains having a desired silver iodide content can be fed singly. Also, so that a desired silver iodide content may be obtained, two or more kinds of silver halide fine grains having different silver halide compositions can be mixed and fed. In cases where the two kinds or more silver halide fine grains are mixed and fed, it is preferable that at least one kind of grain substantially contain one kind of a halogen element.

The silver halide grains to be used in the present invention should preferably have at least one layer with higher silver iodide content (core layer) internally of the grains and at least one layer with lower silver iodide content (shell layer) outside thereof in its silver halide composition structure.

In that case, the silver iodide content in the core layer should be preferably 10 mole % or more, more preferably 15 to 45 mole % or more, further preferably 20 to 40 mole %, particularly preferably 25 to 40 mole %. Its volume should be preferably 10 to 80 mole % of the whole grains, more desirably 15 to 60 mole %, further desirably 15 to 45 mole %.

The silver iodide content in the shell layer formed outside of the core layer should be preferably 15 mole % or less, more preferably 10 mole % or less, particularly preferably 5 mole % or less. Its volume should be preferably 3 to 70 mole % of the whole grains, more preferably 5 to 50 mole %.

Further, between the silver iodide contents of the core layer and the shell layer, there should be preferably a difference of 5 mole % or more, particularly preferably 10 mole % or more.

Between the core layer and the shell layer, there may also exist a layer with another silver iodide content (intermediate layer). In that case, the intermediate layer should preferably have a silver iodide content which is smaller than said core layer and larger than said shell layer. Its volume should be preferably 5 to 70 mole % of the whole grains, further preferably 10 to 65 mole %.

In the above-mentioned embodiment, there may also exist still other silver halide layers between said core layer and the intermediate layer and between the intermediate layer and the shell layer.

Further, it is also preferable that the silver halide grains of the present invention should have a layer higher in silver iodide content than said shell layer outside of the shell layer (surface layer). In that case, the volume of the surface layer should be 35% or less of the grains, more preferably 25% or less, particularly preferably 15% or less.

The silver halide grains to be used in the present invention should preferably contain at least silver iodide, and the silver halide composition other than that is not particularly limited. For example, it can be constituted of any desired composition such as silver iodobromide, silver chloroiodide, silver chloroiodobromide and mixtures of these, etc., but in the present invention, particularly silver iodobromide is preferred.

The silver halide emulsion to be used in the present invention should preferably comprise a silver iodobromide with its average silver iodide content of 4 to 20 mole %, particularly preferably 5 to 15 mole %.

In the present invention, together with the silver halide emulsion according to the above fine grain feeding method, known silver halide emulsions can be used. As known silver halide emulsions, those described in Research Disclosure 308119 (hereinafter abbreviated as RD308119) can be used. In the following table, described places are shown.

| (Item) | (Page in RD308119) |
|---|---|
| Iodide structure | 993 I-A |
| Preparation method | 993 I-A and 994 E |
| Crystal habit | |
| normal | 993 I-A |
| twin | 993 I-A |
| Epitaxial | 993 I-A |
| Halogen composition | |
| uniform | 993 I-B |
| not uniform | 993 I-B |
| Halogen conversion | 994 I-C |
| Halogen conversion substitution | 994 I-C |
| Metal containing | 994 I-D |
| Mono-dispersed | 995 I-F |
| Solvent addition | 995 I-F |
| Latent image formation position | |
| surface | 995 I-G |
| inner portion | 995 I-G |
| Applied sensitive material | |
| nega | 995 I-H |
| posi (containing internal fog grains) | 995 I-H |
| Used in admixture with emulsion | 995 I-J |
| Desalting | 995 II-A |

In the present invention, it is preferably to use a silver halide emulsion which is subjected to physical aging, chemical aging and spectral sensitization. As the additives to be used in such steps, those described in Research Disclosure No. 17643, No. 18716 and No. 308119 (hereinafter abbreviated as RD17643, RD18716 and RD308119 respectively) may be included.

In the following, described places are shown.

| (Item) | (page in RD308119) | (RD17643) | (RD18716) |
|---|---|---|---|
| Chemical sensitizer | 996 III-A | 23 | 648 |

-continued

| (Item) | (page in RD308119) | (RD17643) | (RD18716) |
|---|---|---|---|
| Spectral sensitizer | 996 IV-A-A,B,C D,H,I,J | 23–24 | 648–9 |
| Super sensitizer | 996 IV-A-E,J | 23–24 | 648–9 |
| Antifoggant | 998 VI | 24–25 | 649 |
| Stabilizer | 998 VI | 24–25 | 649 |

Known additives for photography which can be used in the present invention are also described in the above Research Disclosure. In the following table, related described places are shown.

| (Item) | (page in RD308119) | (RD17643) | (RD18716) |
|---|---|---|---|
| Color turbidity preventive | 1002 VII - I | 25 | 650 |
| Dye image stabilizer | 1001 VII - J | 25 | |
| Brightening agent | 998 V | 24 | |
| UV-ray absorber | 1003 VIII C, XIII C | 25–26 | |
| Light absorber | 1003 VIII | 25–26 | |
| Light scatterer | 1003 VIII | | |
| Filter dye | 1003 VIII | 25–26 | |
| Binder | 1003 IX | 26 | 651 |
| Antistatic agent | 1006 XIII | 27 | 650 |
| Film hardener | 1004 X | 26 | 651 |
| Plasticizer | 1006 XII | 27 | 650 |
| Lubricant | 1006 XII | 27 | 650 |
| Activator coating aid | 1005 XI | 26–27 | 650 |
| Matting agent | 1007 XVI | | |
| Developer (contained in light-sensitive material) | 1011 XX-B | | |

In the present invention, various additives can be used, and specifically those described in the above Research Disclosure can be used. In the following, related described places are shown.

| (Item) | (Page in RD308119) | (RD17643) |
|---|---|---|
| Colored coupler | 1002 VII-G | VII G |
| DIR coupler | 1001 VII-F | VII F |
| BAR coupler | 1002 VII-F | |
| Other useful residue releasing couplers | 1001 VII-F | |
| Alkali soluble coupler | 1001 VII-E | |

The additives to be used in the present invention can be added according to the dispersion method described in RD308119 XIV, etc.

The light-sensitive silver halide color photographic material of the present invention should preferably have two or more layers of silver halide emulsion layers on the support.

In the present invention, it is preferable to have at least a blue-sensitive emulsion layer spectrally sensitized to 400 to 500 nm, a green-sensitive emulsion layer spectrally sensitized to 500 to 600 nm and a red-sensitive emulsion layer spectrally sensitized to 600 to 700 nm as the silver halide emulsion layers.

Also, each light-sensitive emulsion layer should be preferably constituted of a plurality of layers which are highly sensitive, moderately sensitive, low sensitive, etc.

In the light-sensitive material of the present invention, auxiliary layers such as the filter layer, the intermediate layer, etc. described in RD308119 VII-K as mentioned above can be provided.

The light-sensitive material of the present invention can take various layer constitutions such as normal layers, reverse layers, unit constitution, etc. as described in RD308119 VII-K as mentioned above.

The present invention can be applied to various color light-sensitive materials as represented by color nega films for general purpose or for movie, color reversal films for slide or for television, color papers, color posi films, color reversal papers.

The light-sensitive material of the present invention can be developed according to conventional method as described in RD17643 pages 28–29, RD18716 page 647 and RD308119 XIX as mentioned above.

The light-sensitive silver halide photographic material should be preferably stored under the state of a relative humidity of 55% or lower.

In the present invention, for storage under the state of a relative humidity of 55% or lower, it is preferable to use a hermeticaly closed packaging means.

The hermeticaly closed packaging as mentioned in the present invention refers to performing humidity proof packaging well known in the field of packaging. As the packaging material, metals and metal foils such as aluminum plate, tin plate, aluminum foil, etc., glass or polymers such as polyethylene, polyvinyl chloride, polystyrene, polyvinylidene chloride, polypropylene, polycarbonate, polyamide, etc., composite laminated agents with various polymers and a base material such as cellophane, paper, aluminum foil, etc. (laminate materials as mentioned in packaging terms), etc. may be employed.

As the hermetically closing sealing method, there can be employed the adhesive method by use of various adhesives, the thermal adhering method such as heat seal, etc., and otherwise the method by use of patrone case which is general in this field of photography. Details of these sealing methods are described in "Handbook of Food Packaging Technique" edited by Society of Packaging Technique of Japan, p. 573–p. 609, etc.

In the present invention, storage under the state of a relative humidity of 55% or lower is defined as the difference $\Delta W^{55} = W_2^{55} - W_1^{55}$ which is the difference between the weight $W_1^{55}$ measured by opening the light-sensitive silver halide material hermetically closed stored at, for example, 25° C..relative humidity 55% within 30 seconds, and $W_2^{55}$ measured after storage for 3 days or longer under the same conditions being 0 or higher.

Preferable conditions in the present invention are that the weight change $\Delta W^{30}$ at 25° C..relative humidity 30% becomes negative, and more preferable conditions are that the weight change $\Delta W^{35}$ at 25° C..relative humidity 35% becomes negative.

In the present invention, the hermetically closed packaging may be done doubly.

For packaging under low relative humidity conditions as described above, the light-sensitive silver halide material may be packaged in a room of low humidity, or said light-sensitive material may be excessively dried during drying thereof, and also a drying agent such as silica gel, etc. may be placed within a hermetically closed vessel to make the humidity lower.

In the following, the present invention is described by referring to specific examples, by which the present invention is not limited at all.

EXAMPLE-1

Preparation of EM-A - EM-E

Preparation of Hexagonal Flat Plate Silver Iodobromide Emulsion EM-A

A hexagonal flat plate silver iodobromide emulsion was prepared with a flat plate iodobromide emulsion (silver iodide content 20 mole %) having a diameter corresponding to an average circle of 0.70 μm and an average aspect ratio of 3 as the seed crystal.

While maintaining the solution (G-10) within the reaction vessel at a temperature of 65° C., pAg 9.7, pH 6.8, under well stirring, a seed emulsion corresponding to 1.57 mole was added.

Then, (H-10) and (S-10) were added into the reaction vessel according to the double jet method at accelerated flow rate while maintaining the flow rate ratio of 1:1 over 58 minutes.

The pAg and the pH during grain formation were controlled by adding an aqueous potassium bromide solution and an aqueous potassium hydroxide solution into the reaction vessel.

After grain formation, water washing treatment was applied according to conventional flocculation method, and then gelatin was added to effect re-dispersion, and the pH and the pAg were respectively adjusted to 5.8 and 8.06 at 40° C.

The emulsion obtained was found to be a mono-dispersed emulsion comprising hexagonal flat plate silver iodobromide grains with an average circle corresponding diameter of 1.38 μm, an average aspect ratio of 4, a broadness of distribution of 13.8% and a content of silver iodide of 8.5 mole %. This emulsion is called EM-A.

Preparation of Hexagonal Flat Plate Silver Iodobromide Emulsion EM-B

Similarly as the emulsion EM-A, an emulsion EM-B was prepared. However, as the seed crystal a flat plate silver iodobromide emulsion with a silver iodide content of 8 mole % was employed. Also, (H-11) was employed as the addition solution of the halide.

The emulsion obtained was found to be a mono-dispersed emulsion comprising hexagonal flat plate silver iodobromide grains with an average circle corresponding diameter of 1.38 μm, a broadness of distribution of 13.6% and a silver iodide content of 8.0 mole %.

Preparation of Hexagonal Flat Plate Silver Iodobromide Emulsion EM-C

A hexagonal flat plate silver iodobromide emulsion was prepared with a hexagonal flat plate silver iodobromide emulsion (silver iodide content 20 mole %) with an average circle corresponding diameter of 0.70 μm and an average aspect ratio of 3 as the seed crystal.

While maintaining the solution (G-10) in the reaction vessel at a temperature of 65° C., pAg 9.7, pH 6.8, under well stirring, the seed emulsion corresponding to 1.57 mole was added. Prior to addition of the fine grain emulsion, 7.26 mole of ammonium acetate was added. Then, from a mixer for preparation of silver halide fine grain provided in the vicinity of the reaction vessel, the fine grain emulsion was continuously fed into the reaction vessel to carry out crystal growth.

Into the mixer, (G-20) and (H-20) and (S-20) were added under pressurization according to the triple jet method at accelerated flow rate over 93 minutes. From the mixer, the fine grain emulsion corresponding to the reaction mixture amount added was fed successively into the reaction vessel.

During this operation, the temperature of the mixer was maintained at a temperature of 40° C., and the rotational number of the stirring blade at 4,000 r.p.m. The fine grains fed into the reaction mixture had a grain size of 0.015 μm.

The pAg and the pH during grain formation were controlled by adding an aqueous potassium bromide solution and an aqueous potassium hydroxide solution into the reaction vessel.

After grain formation, water washing treatment was applied according to conventional flocculation method, then gelatin was added to effect re-dispersion, and the pH and the pAg were respectively adjusted to 5.8 and 8.06 at 40° C.

The emulsion obtained was found to be a mono-dispersed emulsion comprising hexagonal flat plate silver iodobromide grains with an average circle corresponding diameter of 1.38 μm, a broadness of distribution of 13.1% and a silver iodide content of 8.5 mole %. This emulsion is called EM-C.

Preparation of Hexagonal Flat Plate Silver Iodobromide Emulsion EM-D

Similarly as the EM-C, an emulsion EM-D was prepared. However, a flat plate silver iodobromide emulsion with a silver iodide content of 8 mole % was used as the seed crystal. Also, as the addition solution of the halide, (H-21) was employed.

The emulsion obtained was found to be a mono-dispersed emulsion comprising hexagonal flat plate silver iodobromide grains with an average circle corresponding diameter of 1.38 μm, a broadness of distribution of 12.8% and a silver iodide content of 8.0 mole %.

Preparation of Hexagonal Flat Plate Silver Iodobromide Emulsion EM-E

A hexaangular flat plate silver iodobromide emulsion was prepared with a hexaangular flat plate silver iodobromide emulsion (silver iodide content 20 mole %) with an average circle corresponding diameter of 0.70 μm and an average aspect ratio of 3 as the seed crystal.

While maintaining the solution (G-10) in the reaction vessel at a temperature of 65° C., pAg 9.7, pH 6.8, under well stirring, the seed emulsion corresponding to 1.57 mole was added. Prior to addition of the fine grain emulsion, 7.26 mole of ammonium acetate was added. Then, into a mixer for preparation of silver halide fine grain provided in the vicinity of the reaction vessel, (G-20) and (H-20) and (S-20) were added according to the triple jet method at a constant flow rate to prepare continuously the fine particle emulsion. The prepared fine grain emulsion was fed successively into the accumlation tank. When some amounts of the fine grain emulsion were accumulated in the accumlation tank, the fine grain emulsion was added from the accumlation tank into the reaction vessel at an accelerated flow rate for 84 minutes.

During this operation, the temperature of the mixer was maintained at a temperature of 30° C., and the rotational number of the stirring blade at 4,000 r.p.m. Further, the temperature of the accumlation tank was maintained at 20° C. The fine grains fed into the reaction vessel had a constant average grain size of 0.01 μm.

The pAg and the pH during grain formation were controlled by adding an aqueous potassium bromide solution and an aqueous potassium hydroxide solution into the accumlation tank and by controlling the pAg and the pH of the fine grain emulsion fed into the reaction vessel.

After grain formation, water washing treatment was applied according to conventional flocculation method, then gelatin (average molecular weight: 100,000) was added to effect redispersion, and the pH and the pAg were respectively adjusted to 5.8 and 8.06 at 40° C.

The emulsion obtained was found to be a mono-dispersed emulsion comprising hexagonal flat plate silver iodobromide grains with an average circle corresponding diameter of 1.38 μm, a broadness of distribution of 12.5% and a silver iodide content of 8.5 mole %. This emulsion is called EM-E.

| | |
|---|---|
| (G-10) | |
| Ossein gelatin (average molecular weight of 100,000) | 120.0 g |
| Compound-1 | 25.0 ml |
| 28% Aqueous ammonia | 440.0 ml |
| 56% Aqueous acetic acid | 660.0 ml |
| With water | 4000.0 ml |
| (H-10) | |
| Potassium bromide | 812.2 g |
| Potassium iodide | 72.3 g |
| With water | 2074.3 ml |
| (S-10) | |
| Silver nitrate | 1233.3 g |
| 28% Aqueous ammonia | equivalent weight |
| With water | 2074.3 ml |
| (H-11) | |
| Potassium bromide | 794.9 g |
| Potassium iodide | 96.4 g |
| With water | 2074.3 ml |
| (G-20) | |
| Ossein gelatin (average molecular weight of 40,000) | 300.0 g |
| With water | 2000.0 ml |
| (H-20) | |
| Potassium bromide | 812.2 g |
| Potassium iodide | 72.3 g |
| With water | 2000.0 ml |
| (S-20) | |
| Silver nitrate | 1233.3 g |
| With water | 2000.0 ml |
| (H-21) | |
| Potassium bromide | 794.9 g |
| Potassium iodide | 96.4 g |
| With water | 2000.0 ml |

Compound-1: 10% aqueous ethanolic solution of polyisopropylene.polyethyleneoxy.disuccinate sodium salt

Preparation of EM-1 - EM-3

Preparation of Octagonal Silver Iodobromide Emulsion EM-1

With a mono-dispersed silver iodobromide grain (silver iodide content 2 mole %) with an average grain size of 0.33 μm as the seed crystal, an octagonal silver halide emulsion was prepared according to the double jet method.

While maintaining the solution (G-1) at a temperature of 70° C., pAg 7.8, pH 7.0, under well stirring, a seed emulsion corresponding to 0.34 mole was added.

Formation of Internal High Iodide Layer - Core Layer

Then, (H-1) and (S-1) were added at accelerated flow rate (the flow rate on completion is 3.6-fold of the initial flow rate) while maintaining a flow rate ratio of 1:1 over 86 minutes.

Formation of External Low Iodide Layer - Shell Layer

Subsequently, while maintaining pAg 10.1, pH 6.0, (H-2) and (S-2) were added at accelerated flow rate (the flow rate on completion is 5.2-fold of the initial flow rate) at a flow rate ratio of 1:1 over 65 minutes. The pAg and the pH during grain formation were controlled by use of an aqueous potassium bromide solution and an aqueous 56% acetic acid.

After grain formation, water washing treatment was applied according to conventional flocculation method, and then gelatin was added to effect re-dispersion, and the pH and the pAg were controlled respectively to 5.8 and 8.06 at 40° C.

The emulsion obtained was found to be a mono-dispersed emulsion containing octagonal silver iodobromide grains with an average grain size of 0.99 μm, a broadness of distribution of 12.4% and a silver iodide content of 8.5 mole %. This emulsion is called EM-1.

| | |
|---|---|
| (G-1) | |
| Ossein gelatin | 100.0 g |
| Compound-I* | 25.0 ml |
| 28% Aqueous ammonia | 440.0 ml |
| 56% Aqueous acetic acid | 660.0 ml |
| With water | 5000.0 ml |
| (H-1) | |
| Ossein gelatin | 82.4 g |
| Potassium bromide | 151.6 g |
| Potassium iodide | 90.6 g |
| With water | 1030.5 ml |
| (S-1) | |
| Silver nitrate | 309.2 g |
| 28% Aqueous ammonia | equivalent weight |
| With water | 1030.5 ml |
| (H-2) | |
| Ossein gelatin | 302.1 g |
| Potassium bromide | 770.0 g |
| Potassium iodide | 33.2 g |
| With water | 3776.8 ml |
| (S-2) | |
| Silver nitrate | 1133.0 g |
| 28% Aqueous ammonia | equivalent amount |
| With water | 3776.8 ml |

*Compound-I is the same as used in Example 1.

Preparation of Silver Bromide Fine Grain Emulsion MC-1

Into 5000 ml of a 9.6% by weight gelatin solution containing 0.05 mole of potassium bromide were added each 2500 ml of 10.6 mole silver nitrate and an aqueous solution containing 10.6 mole of potassium bromide at accelerated flow rate (the flow rate on completion is 5-fold of the initial flow rate) over 28 minutes. The temperature during grain formation was maintained at 35° C. The silver bromide fine grains obtained were confirmed by an electron microscope photograph with a magnification of ×60,000, whereby the average grain size was found to be 0.032 μm. The fine particle emulsion was accumulated in the accumlation tank after formation.

Preparation of Silver Iodide Fine Grain Emulsion MC-2

Into 5000 ml of a 9.6% by weight gelatin solution containing 0.05 mole of potassium iodide were added each 2500 ml of an aqueous solution containing 10.6 mole of silver nitrate, 10.6 mole of potassium iodide at accelerated flow rate (the flow rate on completion is 5-fold of the initial flow rate) over 28 minutes. The temperature during fine grain formation was maintained at 35° C. When the silver bromide fine grains obtained were confirmed by an electron microscope photograph with a magnification of ×60,000, the average grain size was found to be 0.027 μm.

Preparation of Silver Iodobromide Fine Grain Emulsion MC-3

Into 5000 ml of a 9.6% by weight gelatin solution containing 0.05 mole of potassium bromide were added each 2500 ml of an aqueous solution containing 10.6 mole of silver nitrate, 10.28 mole of potassium bromide and 0.31 mole of potassium iodide at accelerated flow rate (the flow rate on completion is 5-fold of the initial flow rate) over 28 minutes. The temperature during fine grain formation was maintained at 35° C. When the silver bromide fine grains obtained were confirmed by an electron microscope photograph with a magnification of ×60,000, the average grain size was found to be 0.032 μm.

Preparation of Octagonal Silver Iodobromide Emulsion EM-2

With a mono-dispersed silver iodobromide grain (silver iodide content 2 mole %) with an average grain size of 0.33 μm as the seed crystal, by feeding silver halide fine grains, an octagonal silver iodobromide emulsion was prepared.

While maintaining the solution (G-1) at a temperature of 70° C., pAg 7.8, pH 7.0 under well stirring, 144.4 ml of the seed emulsion corresponding to 0.34 mole was added. Subsequently, an aqueous ammonium acetate corresponding to 8.83 mole was added.

Formation of Internal High Iodide Layer - Core Layer

Then, the silver bromide grain emulsion (MC-1) and the silver iodide fine grain emulsion (MC-2) were added at accelerated flow rate (the flow rate on completion is 3.6-fold of the initial flow rate) while maintaining molar ratio of 70:30 over 86 minutes. The fine grains consumed during this period corresponded to 1.82 mole as the total of (MC-1) and (MC-2).

Formation of External Low Iodide Layer - Shell Layer

Subsequently, while maintaining at pAg 10.1, pH 6.0, the silver bromide fine grain emulsion (MC-1) and the silver iodide fine grain emulsion (MC-2) were added at accelerated flow rate (the flow rate on completion is 5.2-fold of the initial flow rate) while maintaining a molar ratio of 97:3 over 65 minutes. The fine grains consumed during this period corresponded to 6.67 moles as the total of (MC-1) and (MC-2).

During grain formation, the pH was controlled by use of 28% aqueous ammonia.

Then, similarly as the emulsion EM-1, water washing treatment and adjustment of pH, pAg were applied.

The emulsion obtained was found to be a mono-dispersed emulsion containing an octagonal silver iodobromide fine grains with an average grain size of 0.99 μm, a broadness of distribution of 10.7% and a silver iodide content of 8.5 mole %. This emulsion is called EM-2.

Preparation of Octagonal Silver Iodobromide Emulsion EM-3

According to the preparation method of EM-1 and EM-2, an octagonal silver iodobromide emulsion was prepared.

While maintaining the solution (G-1) at a temperature of 70° C., pAg 7.8, pH 7.0 under well stirring, 144.4 ml of the seed emulsion corresponding to 0.34 mole was added.

Formation of Internal High Iodide Layer - Core Layer

Following the preparation method of EM-1, a core layer was formed.

The pAg and the pH during the shell layer formation were controlled by use of an aqueous potassium bromide and a 56% aqueous acetic acid.

Formation of External Low Iodide Layer - Shell Layer

Subsequently, an aqueous ammonium acetic acid corresponding to 6.67 mole was added, and while maintaining at pAg 10.1, pH 6.0, the silver iodobromide fine grain emulsion (MC-3) was added at accelerated flow rate (the flow rate on completion is 5.2-fold of the initial flow rate) over 65 minutes. The fine grains (MC-3) consumed during this period corresponded to 6.67 mole.

The pH during shell layer formation was controlled by use of 28% aqueous ammonia.

Then, similarly as the emulsion (EM-1), water washing treatment and adjustment of pH, pAg were applied.

The emulsion obtained was found to be a mono-dispersed emulsion containing an octagonal silver iodobromide grains with an average grain size of 0.99 μm, a broadness of distribution of 10.6% and a silver iodide content of 8.5 mole %. This emulsion is called EM-3.

Preparation of Light-sensitive Silver Halide Photographic Material Sample

Each emulsion of EM-A - EM-D and each emulsion of EM-1 - EM-3 were applied optimally with conventional chemical sensitization and spectral sensitization, and by use of these emulsions, on a triacetyl cellulose film (TAC) support, the respective layers with the compositions as shown below were formed successively from the support side to prepare a Sample No. 101 for comparison of a multi-layer light-sensitive color photographic material.

However, in all of the examples shown below, the amounts added in the silver halide light-sensitive photographic material are grams per 1 $m^2$ unless otherwise particularly noted, and silver halide and colloidal silver are shown as calculated on silver.

| | |
|---|---|
| First layer: | |
| Halation preventive layer (HC) | |
| Black colloidal silver | 0.15 g |
| UV ray absorber (UV-1) | 0.20 g |
| Colored coupler (CC-1) | 0.02 g |
| High boiling solvent (Oil-1) | 0.20 g |
| High boiling solvent (Oil-2) | 0.20 g |
| Gelatin | 1.6 g |
| Second layer: Intermediate layer (IL-1) | |
| Gelatin | 1.3 g |
| Third layer: Low sensitivity red-sensitive emulsion layer (R-L) | |
| Silver iodobromide emulsion (average grain size 0.3 μm) | 0.4 g |
| Silver iodobromide emulsion (average grain size 0.4 μm) | 0.3 g |
| Sensitizing dye (S-1) | $3.2 \times 10^{-4}$ (mole/silver 1 mole) |
| Sensitizing dye (S-2) | $3.2 \times 10^{-4}$ (mole/silver 1 mole) |
| Sensitizing dye (S-3) | $0.2 \times 10^{-4}$ (mole/silver 1 mole) |
| Cyan coupler (C-1) | 0.50 g |

-continued

| | |
|---|---|
| Cyan coupler (C-2) | 0.13 g |
| Colored cyan coupler (CC-1) | 0.07 g |
| DIR compound (D-1) | 0.006 g |
| DIR compound (D-2) | 0.01 g |
| High boiling solvent (Oil-1) | 0.55 g |
| Gelatin | 1.0 g |
| Fourth layer: High sensitivity red-sensitive emulsion layer (R-H) | |
| Silver iodobromide emulsion (average grain size 0.7 μm) | 0.9 g |
| Sensitizing dye (S-1) | $1.7 \times 10^{-4}$ (mole/silver 1 mole) |
| Sensitizing dye (S-2) | $1.6 \times 10^{-4}$ (mole/silver 1 mole) |
| Sensitizing dye (S-3) | $0.1 \times 10^{-4}$ (mole/silver 1 mole) |
| Cyan coupler (C-2) | 0.23 g |
| Colored cyan coupler (CC-1) | 0.03 g |
| DIR compound (D-2) | 0.02 g |
| High boiling solvent (Oil-1) | 0.25 g |
| Gelatin | 1.0 g |
| Fifth layer: Intermediate layer (IL-2) | |
| Gelatin | 0.8 g |
| Sixth layer: Low sensitivity green-sensitive emulsion layer (G-L) | |
| Silver iodobromide emulsion (average grain size 0.4 μm) | 0.6 g |
| Silver iodobromide emulsion (average grain size 0.3 μm) | 0.2 g |
| Sensitizing dye (S-4) | $6.7 \times 10^{-4}$ (mole/silver 1 mole) |
| Sensitizing dye (S-5) | $0.8 \times 10^{-4}$ (mole/silver 1 mole) |
| Magenta coupler (M-1) | 0.60 g |
| Colored magenta coupler (CM-1) | 0.10 g |
| DIR compound (D-3) | 0.02 g |
| High boiling solvent (Oil-2) | 0.7 g |
| Gelatin | 1.0 g |
| Seventh layer: High sensitivity green-sensitive emulsion layer (G-H) | |
| Silver iodobromide emulsion (EM-B) | 0.9 g |
| Sensitizing dye (S-6) | $1.1 \times 10^{-4}$ (mole/silver 1 mole) |
| Sensitizing dye (S-7) | $2.0 \times 10^{-4}$ (mole/silver 1 mole) |
| Sensitizing dye (S-8) | $0.3 \times 10^{-4}$ (mole/silver 1 mole) |
| Magenta coupler (M-1) | 0.16 g |
| Colored magenta coupler (CM-1) | 0.04 g |
| DIR compound (D-3) | 0.004 g |
| High boiling solvent (Oil-2) | 0.35 g |
| Gelatin | 1.0 g |
| Eighth layer: Yellow filter layer (YC) | |
| Yellow colloidal silver | 0.1 g |
| Additive (HS-1) | 0.07 g |
| Additive (HS-2) | 0.07 g |

-continued

| | |
|---|---|
| Additive (SC-1) | 0.12 g |
| High boiling solvent (Oil-2) | 0.15 g |
| Gelatin | 1.0 g |
| Ninth layer: Low sensitivity blue-sensitive emulsion layer (B-L) | |
| Silver iodobromide emulsion (average grain size 0.3 μm) | 0.25 g |
| Silver iodobromide emulsion (average grain size 0.4 μm) | 0.25 g |
| Sensitizing dye (S-9) | $5.8 \times 10^{-4}$ (mole/silver 1 mole) |
| Yellow coupler (Y-1) | 0.6 g |
| Yellow coupler (Y-2) | 0.32 g |
| DIR compound (D-1) | 0.003 g |
| DIR compound (D-2) | 0.006 g |
| High boiling solvent (Oil-2) | 0.18 g |
| Gelatin | 1.0 g |
| Tenth layer: High sensitivity blue-sensitive emulsion layer (B-H) | |
| Silver iodobromide (average grain size 0.8 μm) | 0.5 g |
| Sensitizing dye (S-10) | $3 \times 10^{-4}$ (mole/silver 1 mole) |
| Sensitizing dye (S-11) | $1.2 \times 10^{-4}$ (mole/silver 1 mole) |
| Yellow coupler (Y-1) | 0.18 g |
| Yellow coupler (Y-2) | 0.10 g |
| High boiling solvent (Oil-2) | 0.05 g |
| Gelatin | 1.0 g |
| Eleventh layer: First protective layer (PRO-1) | |
| Silver iodobromide (average grain size 0.08 μm) | 0.3 g |
| UV ray absorber (UV-1) | 0.07 g |
| UV ray absorber (UV-2) | 0.10 g |
| Additive (HS-1) | 0.2 g |
| Additive (HS-2) | 0.1 g |
| High boiling solvent (Oil-1) | 0.07 g |
| High boiling solvent (Oil-3) | 0.07 g |
| Gelatin | 0.8 g |
| Twelfth layer: Second protective layer (PRO-2) | |
| Matting agent soluble in alkali (average grain size 2 μm) | 0.13 g |
| Polymethyl methacrylate (average grain size 3 μm) | 0.02 g |
| Gelatin | 0.5 g |

In addition to the above compositions, Surfactant Su-2, Surfactant Su-1, viscosity controller, Film hardeners H-1, H-2, Stabilizer ST-1, Antifoggant AF-1, two kinds of AF-2 of Mw: 10,000 and Mw: 1,100,000 and Compound DI-1 were added. However, the amount of the I-1 added was 9.4 mg/m$^2$.

C-1

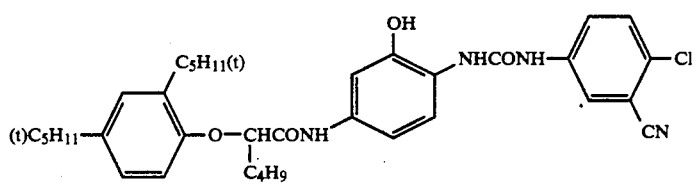

C-2

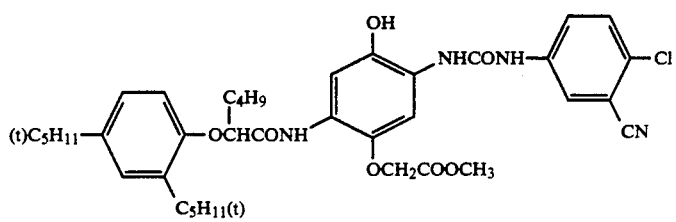

-continued
M-1
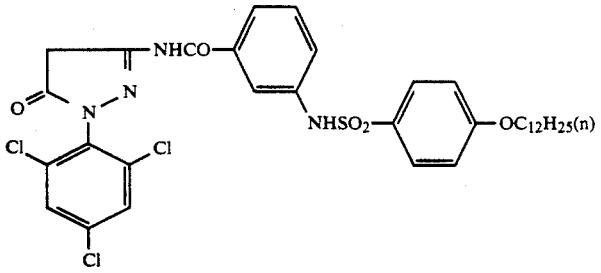
Y-1
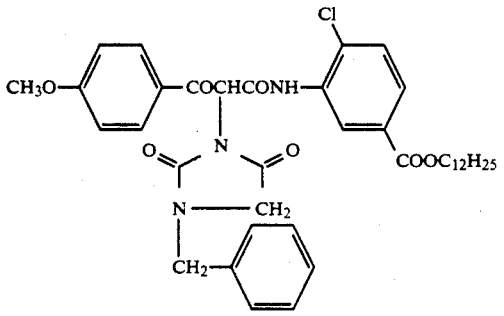
Y-2
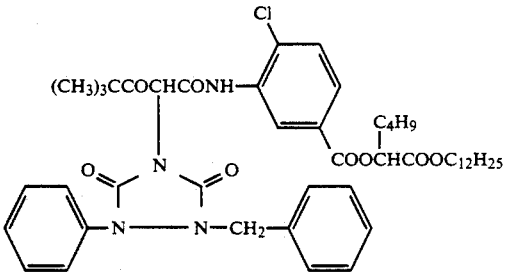
CC-1
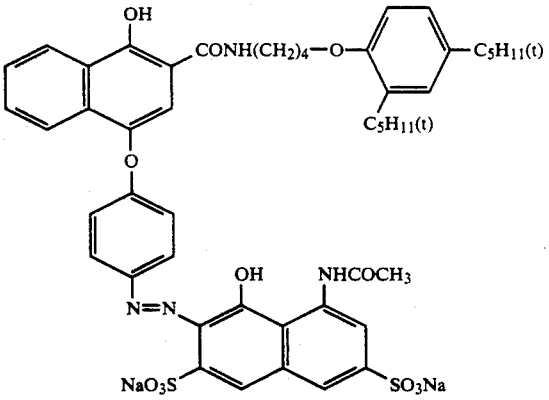
CM-1
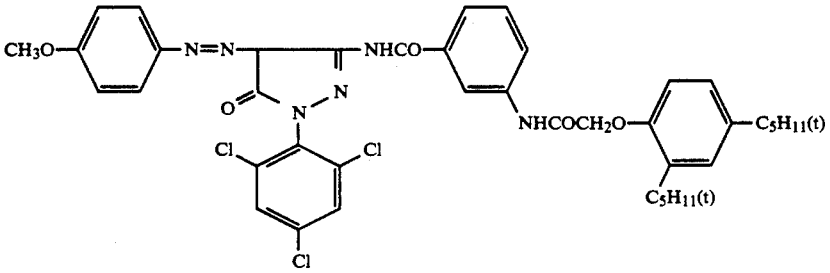

-continued
D-1
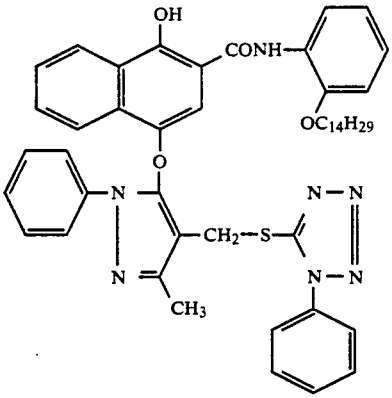
D-2
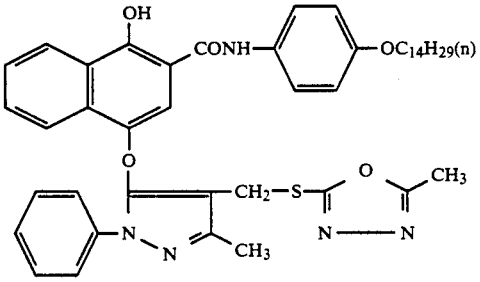
D-3
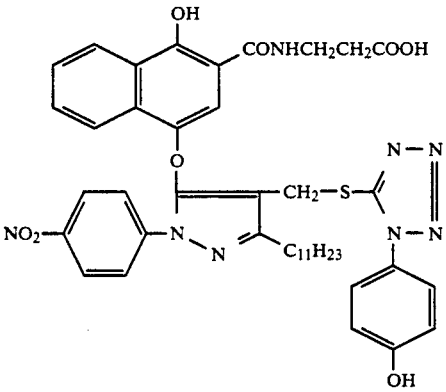
UV-1
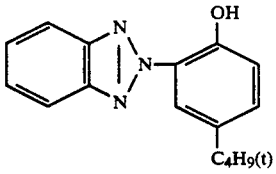
UV-2
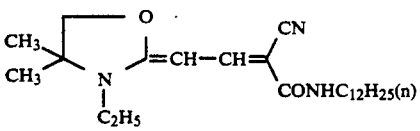
S-1
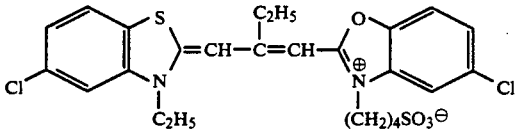

-continued
S-2
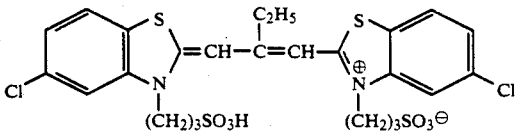
S-3
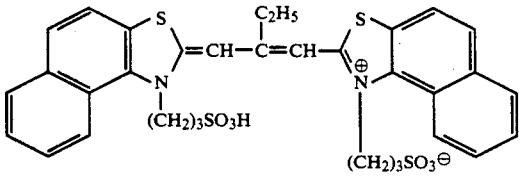
S-4
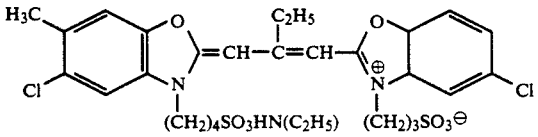
S-5
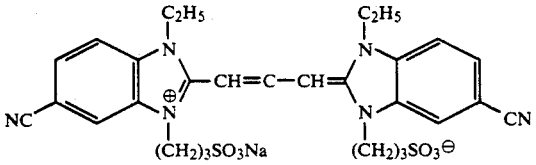
S-6
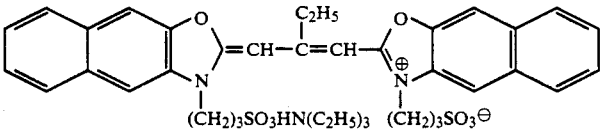
S-7
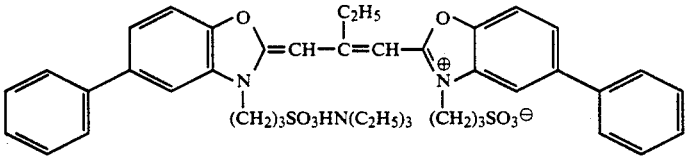
S-8
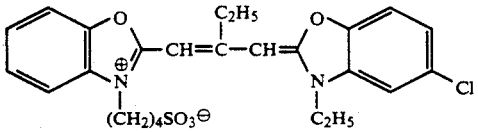
S-9
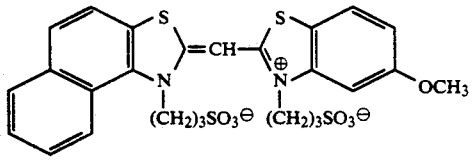
S-10
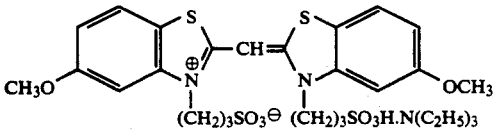
S-11
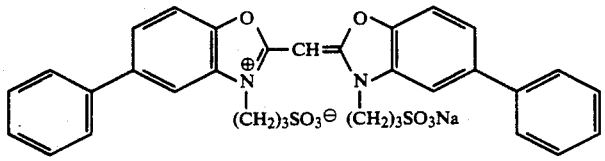

-continued
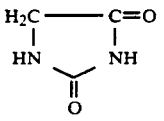
HS-1
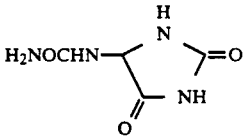
HS-2
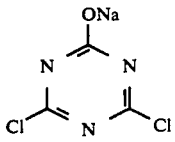
H-1
$(CH_2{=}CHSO_2CH_2)_2O$
H-2
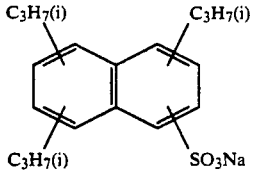
SU-1
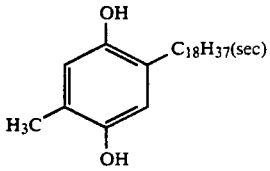
and
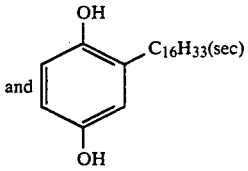
(mixture of 2:3)
SC-1
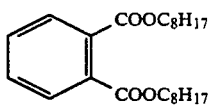
Oil-1
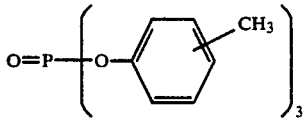
Oil-2
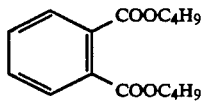
Oil-3
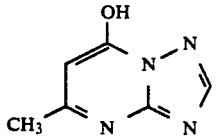
ST-1

-continued

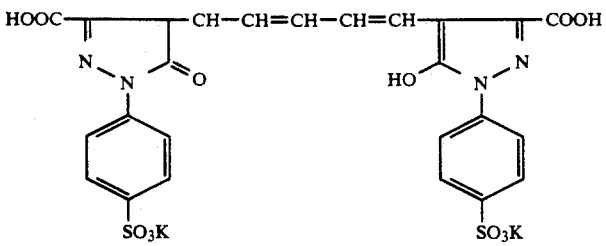

AI-1

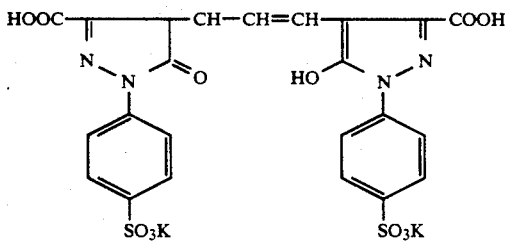

AI-2

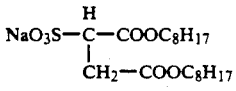

SU-2

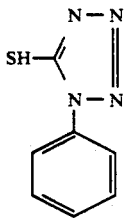

AF-1

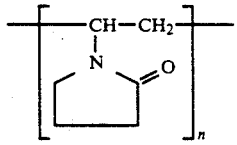

AF-2

(mixture of the following three components)

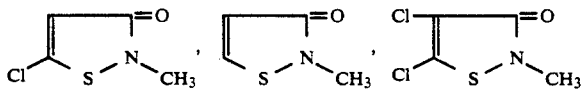

DI-1

(component A) (component B) (component C)

component A: component B: component C = 50:46:4 (molar ratio)

In preparation of the light-sensitive material sample No. 101, the emulsion in the seventh layer, the kind and the thickness of the support were respectively changed as shown in Table 1, following otherwise the same procedure, samples Nos. 102–109 were prepared.

However, the polyethylene terephthalate (PET) support used in the samples Nos. 107 and 109 was prepared as described below.

To 100 parts by weight of dimethyl terephthalate, 70 parts by weight of ethylene glycol, 10 parts by weight of dimethyl 5-sodium sulfoisophthalate and 10 parts by weight of dimethyl adipate were added 0.1 part by weight of calcium acetate and 0.03 part by weight of antimony trioxide, and interesterification reaction was carried out in conventional manner. To the product obtained was added 0.05 part by weight of trimethyl phosphate, and the mixture was gradually elevated in temperature, to reduce a pressure, until polymerization was finally carried out at 280° C., 1 mmHg or lower, to obtain a copolymerized polyethylene terephthalate.

The copolymerized polyethylene terephthalate was dried in conventional manner, then melt extruded at 280° C. to prepare an unstretched sheet. Subsequently, the sheet was stretched to 3.5-fold in the longitudinal direction at 90° C. and to 3.7-fold in the lateral direction at 95° C. successively, followed by thermal fixing at 200° C. for 5 seconds to obtain a biaxially stretched film with a thickness of 55 μm. The film characteristics were 1.2% of haze, 7 kg/mm of strength at break, 340 kg/mm of initial modulus.

The haze, the strength at break and the initial modulus of the film were measured under the following conditions.

Haze of film: measured according to ASTN-D1003-52.

Strength at break and initial modulus: according to JIS-Z1702-1976, by use of a rectangular strip with a width of 10 mm and a length of 100 mm, the tensile strength at break was measured at a tensile speed of 300 m/min., and the initial modulus at 20 mm/min.

Also, the water content was measured by use of a minute amount water content meter Model CA-02 produced by Mitsubishi Kasei K. K. to be 0.7%.

TABLE 1

| Sample No. | Seventh layer emulsion | Support Kind | Support Thickness (μm) |
|---|---|---|---|
| 101 (Comparison) | Em-B | TAC | 125 |
| 102 (Comparison) | Em-B | TAC | 80 |
| 103 (Comparison) | Em-D | TAC | 125 |
| 104 (Present invention) | Em-D | TAC | 80 |
| 105 (Comparison) | Em-A | TAC | 80 |
| 106 (Present invention) | Em-C | TAC | 80 |
| 107 (Present invention) | Em-C | PET | 55 |
| 108 (Present invention) | Em-E | TAC | 80 |
| 109 (Present invention | Em-E | PET | 55 |

EVALUATION OF SAMPLE

For each sample obtained, the bending test as shown below was practiced.

Bending Test

Along the change direction of exposure dosage, the sample was bent at a radius of curvature of 3 mm, a bending angle of 20°, and left to stand for 5 seconds.

This was practiced for both the case when the light-sensitive layer is inner side and the case when it is outside.

For the each sample bent as described above, wedge exposure was applied by use of white light, and development processing was performed according to the processing steps shown below.

For the developed sample, the density was measured by a densitometer Model 310 produced by X-Light, and the density change at the bent portion relative to the portion not bent was evaluated relatively by visual observation according to the evaluation standards shown below. The results are shown in Table 2.

Evaluation Standards

◎ . . . No density change observed at all
○ . . . Slightly observed
Δ . . . Density difference recognized, causing practical problem
X . . . Marked density difference Processing was carried out according to the following processing steps.

| Processing steps (38° C.) | |
|---|---|
| Color developing | 3 min. 15 sec. |
| Bleaching | 6 min. 30 sec. |
| Water washing | 3 min. 15 sec. |
| Fixing | 6 min. 30 sec. |
| Water washing | 3 min. 15 sec. |
| Stabilizing | 1 min. 30 sec. |
| Drying | |

The processing liquor compositions used in the respective processing steps are shown below.

| | |
|---|---|
| (Color developer) | |
| 4-Amino-3-methyl-N-ethyl-N-(β-hydroxyethyl)-aniline.sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Nitriloacetic acid.3 sodium salt (monohydrate) | 2.5 g |
| Potassium hydroxide | 1.0 g |
| Water added to 1 liter (pH = 10.1) | |
| (Bleaching solution) | |
| Iron (III) ammonium ethylenediaminetetraacetate | 100 g |
| Diammonium ethylenediaminetetraacetate | 10 g |
| Ammonium bromide | 150 g |
| Glacial acetic acid | 10 ml |
| Water added to 1 liter, and adjusted to pH = 6.0 with ammonia water | |
| (Fixing solution) | |
| Ammonium thiosulfate | 175.0 g |
| Anhydrous sodium sulfite | 8.5 g |
| Sodium metasulfite | 2.3 g |
| Water added to 1 liter, and adjusted to pH = 6.0 with acetic acid | |
| (Stabilizing solution) | |
| Formalin (37% aqueous solution) | 1.5 ml |
| Konidax (produced by Konica K.K.) | 7.5 ml |
| Water added to 1 liter | |

TABLE 2

| Sample No. | Bending evaluation Inside | Bending evaluation Outside |
|---|---|---|
| 101 (Comparison) | Δ | ○ |
| 102 (Comparison) | X | Δ |
| 103 (Comparison) | Δ | Δ |
| 104 (present invention) | ○ | ○ |
| 105 (Comparison) | X | Δ |
| 106 (Present invention) | ○ | ○ |
| 107 (Present invention) | ○ | ○ |
| 108 (Present invention | ○ | ○ |
| 109 (Present invention) | ○ | ○ |

As is apparent from Table 2, it can be understood that the sample of the present invention is little in density change at the local portion even when the bending test may be practiced.

EXAMPLE -2

In each of the samples Nos. 101–107 prepared in Example-1, the emulsion in the seventh layer and the kind and the thickness of the support were changed as shown in Table 3, following otherwise the same procedure as in Example-1, to prepare samples Nos. 111–117.

For the samples Nos. 111–117, the same processings as in Example 1 were practiced, and the same evaluation was performed.

The results are shown in Table 4.

TABLE 3

| Sample No. | Seventh layer emulsion | Support Kind | Support Thickness (μm) |
|---|---|---|---|
| 111 (Comparison) | EM-1 | TAC | 125 |
| 112 (Comparison) | EM-1 | TAC | 90 |
| 113 (Comparison) | EM-2 | TAC | 125 |
| 114 (Present invention) | EM-2 | TAC | 90 |
| 115 (Comparison) | EM-3 | TAC | 90 |
| 116 (Present invention) | EM-2 | PET | 55 |
| 117 (Present invention) | EM-2 | PET | 65 |

TABLE 4

| Sample No. | Bending evaluation Inside | Bending evaluation Outside |
|---|---|---|
| 111 (Comparison) | Δ | ○ |

TABLE 4-continued

| Sample No. | Bending evaluation Inside | Outside |
|---|---|---|
| 112 (Comparison) | X | Δ |
| 113 (Comparison) | Δ | Δ |
| 114 (present invention) | ○ | ○ |
| 115 (Comparison) | ○ | ○ |
| 116 (Present invention) | ○ | ◎ |
| 117 (Present invention) | ○ | ○ |

As is apparent from Table 4, it can be understood that the sample of the present invention is little in density change as the local portion even when the bending test may be practiced.

EXAMPLE 3

Further, the samples Nos. 101–109, 111–117 obtained in Examples 1, 2 were applied with a running processing shown below, and the same evaluation was performed. As the result, similar effects were recognized.

Running processing was performed until 3-fold of the volume of the stabilizing tank of replenishing solution entered.

| Processing step | Processing time | Processing temperature | Replenishing amount |
|---|---|---|---|
| Color developing | 3 min. 15 sec. | 38° C. | 540 ml |
| Bleaching | 45 sec. | 38° C. | 155 ml |
| Fixing | 1 min. 45 sec. | 38° C. | 500 ml |
| Stabilizing | 90 sec. | 38° C. | 775 ml |
| Drying | 1 min. | 40–70° C. | — |

(Replenishing amount is a value per 1 $m^2$ of light-sensitive material)

However, the stabilizing processing was performed according to the 3-tank countercurrent, and according to the system in which the replenishing solution was fed into the final tank of the stabilizing solution and the overflow was permitted to flow into the previous tank thereof.

Further, a part (275 ml/$m^2$) of the overflow of the stabilizing tank subsequent to the fixing tank was permitted to flow into the fixing tank.

The color developer used had the following composition.

| | |
|---|---|
| Potassium carbonate | 30 g |
| Sodium hydrogen carbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-Amino-3-methyl-N-ethyl-N-(β-hydroxylethyl)-aniline sulfate | 4.6 g |
| Diethylenetriaminepentaacetic acid | 3.0 g |
| Potassium hydroxide | 1.3 g |
| Water added to 1 liter, and adjusted to pH = 10.01 with potassium hydroxide or 20% sulfuric acid. | |

The color developing replenishing solution used had the following composition.

| | |
|---|---|
| Potassium carbonate | 40 g |
| Sodium hydrogen carbonate | 3 g |
| Potassium sulfite | 7 g |
| Sodium bromide | 0.5 g |
| Hydroxylamine sulfate | 3.2 g |
| 4-Amino-3-methyl-N-ethyl-N-(β-hydroxylethyl)-aniline sulfate | 6.0 g |
| Diethylenetriaminepentaacetic acid | 3.0 g |
| Potassium hydroxide | 2 g |

-continued

| | |
|---|---|
| Water added to 1 liter, and adjusted to pH = 10.12 with potassium hydroxide or 20% sulfuric acid. | |

The bleaching solution used had the following composition.

| | |
|---|---|
| Ferric ammonium 1,3-diaminopropanetetraacetate | 0.35 mole |
| Disodium ethylenediaminetetraacetate | 2 g |
| Ammonium bromide | 150 g |
| Glacial acetic acid | 40 ml |
| Ammonium nitrate | 40 g |
| Water added to 1 liter, and adjusted to pH 4.5 with ammonia water or glacial acetic acid. | |

The bleaching replenishing solution used had the following composition.

| | |
|---|---|
| Ferric ammonium 1,3-diaminopropanetetraacetate | 0.40 mole |
| Disodium ethylenediaminetetraacetate | 2 g |
| Ammonium bromide | 170 g |
| Ammonium nitrate | 50 g |
| Glacial acetic acid | 61 ml |
| Water added to 1 liter, adjusted to pH 3.5 with ammonia water or glacial acetic acid, and suitably adjusted so that the pH in the bleaching tank solution can be maintained. | |

The fixing solution and the fixing replenishing solution used had the following composition.

| | |
|---|---|
| Ammonium thiosulfate | 100 g |
| Ammonium thiocyanate | 150 g |
| Anhydrous sodium bisulfite | 20 g |
| Sodium metabisulfite | 4.0 g |
| Disodium ethylenediaminetetraacetate | 1.0 g |
| Water added to 700 ml, and adjusted to pH = 6.5 with glacial acetic acid and ammonia water. | |

The stabilizing solution and the stabilizing replenishing solution used had the following composition.

| | |
|---|---|
| 1,2-benzisothiazoline-3-one | 0.1 g |
| $C_8H_{17}$–(C6H4)–$(CH_2CH_2O)_{10}$–H (50% solution) | 2.0 ml |
| Hexamethylenetetramine | 0.2 g |
| Hexahydro-1,3,5-triflu(2-hydroxyethyl)-5-triazine | 0.3 g |

Water added to 1 liter, and adjusted to pH 7.0 with potassium hydroxide and 50% sulfuric acid.

EXAMPLE 4

Samples 141 to 147 were prepared by varying the emulsions of the forth, seventh and tenth layers, the kind and the thichness of the support of sample 101 in Example 1 as shown in the following Table, and evaluated similarly as in Example 1. As the result, similar effects were recognized.

| Sample No. | 4th, 7th, 10th layer emulsion | Support Kind | Thickness |
|---|---|---|---|
| 141 (Comparison) | Em-B | TAC | 125 |
| 142 (Comparison) | Em-B | TAC | 80 |
| 143 (Comparison) | Em-D | TAC | 125 |
| 144 (present invention) | Em-D | TAC | 80 |

-continued

| Sample No. | 4th, 7th, 10th layer emulsion | Support Kind | Support Thickness |
|---|---|---|---|
| 145 (Comparison) | Em-A | TAC | 80 |
| 146 (Present invention) | Em-C | TAC | 80 |
| 147 (Present invention) | Em-C | PET | 55 |

EXAMPLE 5

One surface (front surface) of a triacetyl cellulose film support was applied with subbing working, and subsequently with the support interposed, on the surface opposite to the surface applied with said subbing working (back surface) were successively formed the layers with the compositions shown below.

| | |
|---|---|
| Back surface first layer | |
| Alumina sol AS-100 (aluminium oxide) (produced by Nissan Kagaku Kogyo KK) | 0.1 g/m$^2$ |
| Diacetyl cellulose | 0.2 g/m$^2$ |
| Back surface second layer | |
| Diacetyl cellulose | 100 mg/m$^2$ |
| Stearic acid | 10 mg/m$^2$ |
| Silica fine particles (average particle size 0.2 μm) | 50 mg/m$^2$ |

On the surface of the triacetyl cellulose film support applied with the subbing working were successively formed the respective layers with the components shown below to prepare a multi-layer light-sensitive color photographic material 151.

| | |
|---|---|
| First layer (antihalation layer) | |
| Black colloidal silver | 0.24 g |
| UV-ray absorber U-1 | 0.14 g |
| UV-ray absorber U-2 | 0.072 g |
| UV-ray absorber U-3 | 0.072 g |
| UV-ray absorber U-4 | 0.072 g |
| High boiling solvent O-1 | 0.31 g |
| High boiling solvent O-2 | 0.098 g |
| Poly-N-vinylpyrrolidone | 0.15 g |
| Gelatin | 2.02 g |
| Second layer (intermediate layer) | |
| High boiling solvent O-3 | 0.011 g |
| Gelatin | 1.17 g |
| Third layer (low sensitivity red-sensitive layer) | |
| Silver iodobromide emulsion spectrally sensitized with red sensitizing dyes S-1, S-2 (silver iodide 3.0 mol %, average grain size 0.30 μm) | 0.60 g |
| Coupler C-1 | 0.37 g |
| High boiling solvent O-2 | 0.093 g |
| Poly-N-vinylpyrrolidone | 0.074 g |
| Gelatin | 1.35 g |
| Fourth layer (high sensitivity red-sensitive layer) | |
| Silver iodobromide emulsion spectrally sensitized with red sensitizing dyes S-1, S-2 (silver iodide 3.0 mol %, average grain size 0.80 μm) | 0.60 g |
| Coupler C-1 | 0.85 g |
| High boiling solvent O-2 | 0.21 g |
| Poly-N-vinylpyrrolidone | 0.093 g |
| Gelatin | 1.56 g |
| Fifth layer (intermediate layer) | |
| Color-mixing preventive agent AS-1 | 0.20 g |
| High boiling solvent O-3 | 0.25 g |
| Matting agent MA-1 | 0.0091 g |
| Gelatin | 1.35 g |
| Sixth layer (low sensitivity green-sensitive layer) | |
| Silver iodobromide emulsion spectrally sensitized with green sensitizing dye S-3 (silver iodide 3.0 mol %, average grain size 0.30 μm) | 0.70 g |
| Coupler M-1 | 0.31 g |
| Coupler M-2 | 0.076 g |
| High boiling solvent O-3 | 0.059 g |
| Poly-N-vinylpyrrolidone | 0.074 g |
| Gelatin | 1.29 g |
| Seventh layer (high sensitivity green-sensitive layer) | |
| Silver iodobromide emulsion spectrally sensitized with green sensitizing dye S-3 (silver iodide 3.0 mol %, average grain size 0.80 μm) | 0.70 g |
| Coupler M-1 | 0.80 g |
| Coupler M-2 | 0.19 g |
| Color-mixing preventive agent AS-1 | 0.055 g |
| High boiling solvent O-3 | 0.16 g |
| Poly N vinylpyrrolidone | 0.12 g |
| Gelatin | 1.91 g |
| Eighth layer (intermediate layer) | |
| Gelatin | 0.90 g |
| Ninth layer (yellow filter layer) | |
| Yellow colloidal silver | 0.11 g |
| Color-mixing preventive agent AS-1 | 0.068 g |
| High boiling solvent O-3 | 0.085 g |
| Matting agent MA-1 | 0.012 g |
| Gelatin | 0.68 g |
| Tenth layer (low sensitivity blue-sensitive layer) | |
| Silver iodobromide emulsion spectrally sensitized with blue sensitizing dye S-4 (silver iodide 3.0 mol %, average grain size 0.30 μm) | 0.70 g |
| Couper M-1 | 0.86 g |
| Image stabilizer G-1 | 0.012 g |
| High boiling solvent O-3 | 0.22 g |
| Poly-N-vinylpyrrolidone | 0.078 g |
| Compound F-1 | 0.020 g |
| Compound F-2 | 0.040 g |
| Gelatin | 1.09 g |
| Eleventh layer (high sensitivity blue-sensitive layer) | |
| Silver iodobromide emulsion spectrally sensitized with blue sensitizing dye S-4 (silver iodide 3.0 mol %, average grain size 0.85 μm) | 0.70 g |
| Coupler Y-1 | 1.24 g |
| Image stabilizer G-1 | 0.017 g |
| High boiling solvent O-3 | 0.31 g |
| Poly-N-vinylpyrrolidone | 0.10 g |
| Compound F-1 | 0.039 g |
| Compound F-2 | 0.077 g |
| Gelatin | 1.73 g |
| Twelfth layer (protective layer-1) | |
| Non-light-sensitive fine particle silver iodobromide (silver iodide 1.0 mol %, average grain size 0.08 μm) | 0.075 g |
| UV-ray absorber U-1 | 0.048 g |
| UV-ray absorber U-2 | 0.024 g |
| UV-ray absorber U-3 | 0.024 g |
| UV-ray absorber U-4 | 0.024 g |
| High boiling solvent O-1 | 0.13 g |
| High boiling solvent O-2 | 0.13 g |
| Compound F-1 | 0.075 g |
| Compound F-2 | 0.15 g |
| Gelatin | 1.2 g |
| Thirteenth layer (protective layer-2) | |
| Slipping agent WAX-1 | 0.041 g |
| Matting agent MA-2 | 0.0090 g |
| Matting agent MA-3 | 0.051 g |
| Surfactant SU-1 | 0.0036 g |
| Gelatin | 0.55 g |

(Note: weight average molecular weight of poly-N-vinylpyrrolidone used in the respective layers is 350,000)

In the light-sensitive material described above, further gelatin film hardeners H-1, H-2, H-3, water-soluble dyes AI-1, AI-2, AI-3, compound DI-1, stabilizer ST-1, antifoggant AF-1 were added suitably, if necessary.

The silver halide emulsions used in the respective light-sensitive layers were all mono-dispersed emulsions with a broadness of distribution of 20% or less. Each emulsion was desalted, washed with water and then applied with the optimum chemical sensitization in the presence of sodium thiosulfate, chloroauric acid and ammonium thiocyanate, followed by addition of the respective sensitizing dyes 4-hydroxy-6-methyl-1,3,3a,7-tetrazaindene, 1-phenyl-5 mercaptotetrazole for sensitizing spectrally the silver halide emulsions used in respective light-sensitive layers.

$$\text{Broadness distribution (\%)} = \frac{\text{Grain size standard deviation}}{\text{Average grain size}} \times 100$$

S-1

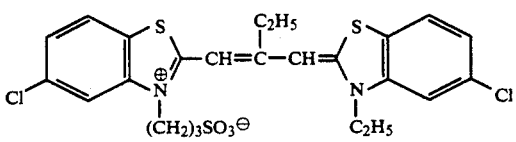

S-2

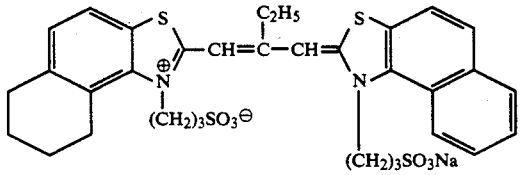

S-3

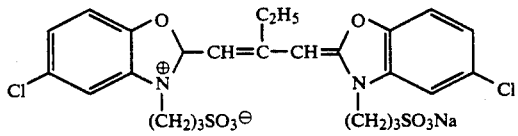

S-4

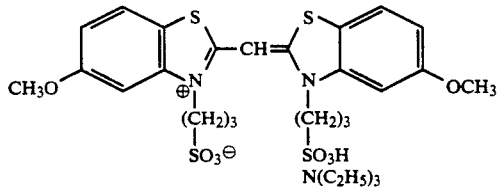

(Coupler)

C-1

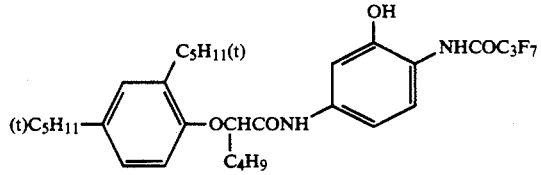

M-1

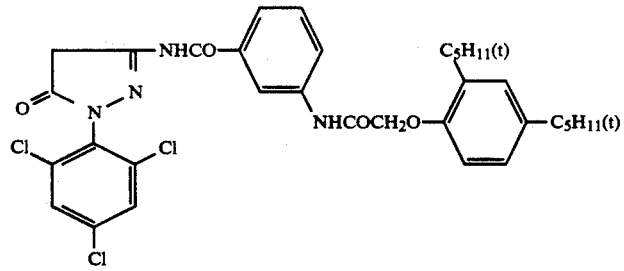

M-2

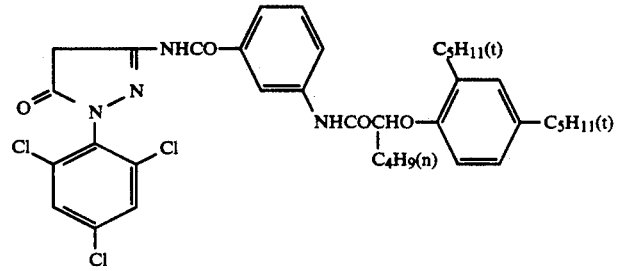

-continued

Y-1

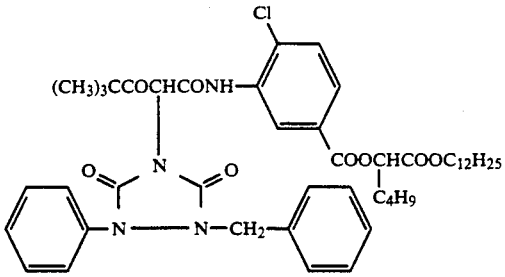

(Compound)

F-1

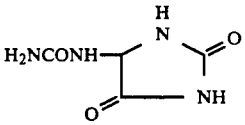

F-2

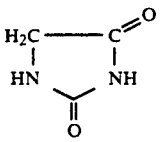

(Matting agent)

Colloidal silica particles (average particle size 3.5 μm) MA-1
Polymethyl methacrylate particle (Average particle size 3.0 μm) MA-2

(MA-3)

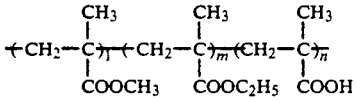

(l:m:n = 30:30:40) (ratio by weight)

(UV-ray absorber)

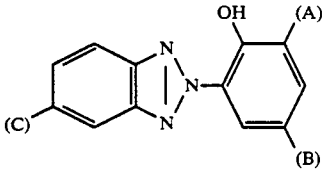

| | A | B | C |
|---|---|---|---|
| U-1 | —H | —$C_4H_9$(t) | —H |
| U-2 | —$C_4H_9$(t) | —$C_4H_9$(t) | —H |
| U-3 | —$C_4H_9$(t) | —$CH_3$ | —Cl |
| U-4 | —$C_4H_9$(t) | —$C_4H_9$(t) | —Cl |

(High boiling solvent)

Di-2-ethylhexylphthalate O-1
Di-butylphthalate O-2
Tricresylphosphate O-3

(Color mixture preventing agent)

Mixture of AS-1

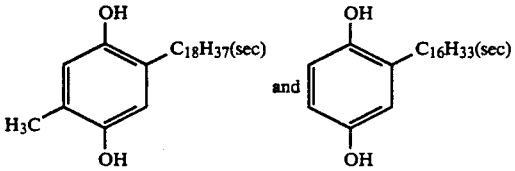

(2:3)

(Image stabilizer)

-continued
G-1
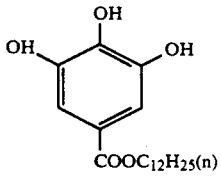
(Slipping agent)
WAX-1
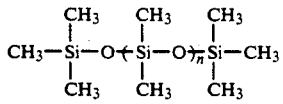
(Weight-average molecular weight: 30,000)
(Surfactant)
SU-1
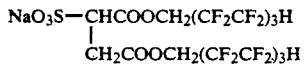
(Film hardner)
H-1
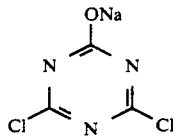
$[(CH_2{=}CHSO_2CH_2)_3CCH_2SO_2(CH_2)_2]_2N(CH_2)_2SO_3K$ H-2
$(CH_2{=}CH{-}SO_2CH_2)_2O$ H-3
(Water soluble dye)
AI-1
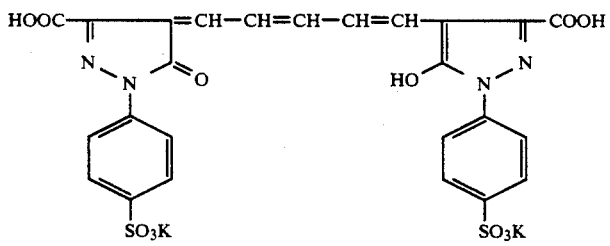
AI-2
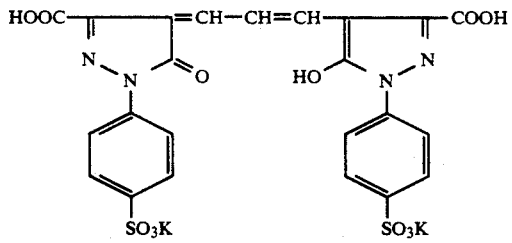
AI-3
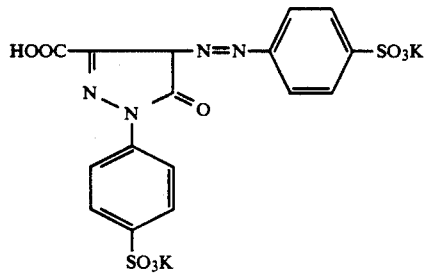
(mixture of the three components shown below)

-continued

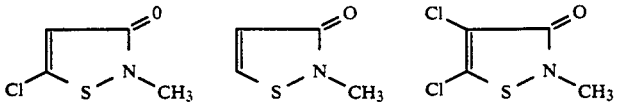

DI-1

(Component A) (Component B) (Component C)

Component A:Component B:Component C = 50:46:4 (molar ratio)

(Stabilizer)

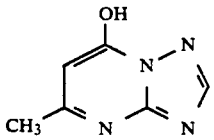

ST-1

(Antifoggant)

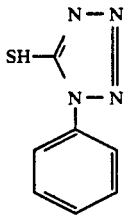

AF-1

Samples 151 to 157 were prepared by varying the emulsions of the fourth, seventh and tenth layers, the kind and the thichness of the support of Sample 151 as shown in the following Table, and evaluated similarly as in Example 1. As the result, similar effect is recognized.

| Sample No. | 4th, 7th, 10th layer emulsion | Support | |
|---|---|---|---|
| | | Kind | Thickness |
| 151 (Comparison) | Em-B | TAC | 125 |
| 152 (Comparison) | Em-B | TAC | 80 |
| 153 (Comparison) | Em-D | TAC | 125 |
| 154 (Present invention) | Em-D | TAC | 80 |
| 155 (Comparison) | Em-A | TAC | 80 |
| 156 (Present invention) | Em-C | TAC | 80 |
| 157 (Present invention) | Em-C | PET | 55 |

Light-sensitive materials 151–157 were given white light exposure through a step wedge for measurement of sensitometry, and subjected to the following developing processing before evaluation.

| Processing step | Processing time | Processing temperature |
|---|---|---|
| First developing | 6 min. | 38° C. |
| Water washing | 2 min. | " |
| Reversal | 2 min. | " |
| Color developing | 6 min. | " |
| Adjusting | 2 min. | " |
| Bleaching | 6 min. | " |
| Fixing | 4 min. | " |
| Water washing | 4 min. | " |
| Stabilizing | 1 min. | normal temperature |
| Drying | | |

The processing liquor compositions used in the above processing steps are as follows.

| | |
|---|---|
| First developer | |
| Sodium tetrapolyphosphate | 2 g |

-continued

| | |
|---|---|
| Sodium sulfite | 20 g |
| Hydroquinone monosulfonate | 30 g |
| Sodium carbonate (monohydrate) | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water added with adjustment of pH 9.60, to make up 1000 ml. | |
| Reversal solution | |
| Hexasodium nitrilotrimethylenephosphonate | 3 g |
| Stannous chloride (dihydrate) | 1 g |
| p-aminophenol | 0.1 g |
| Sodium hydroxide | 8 g |
| Glacial acetic acid | 15 ml |
| Water added with adjustment of pH 5.75, to make up 1000 ml. | |
| Color developing solution | |
| Sodium tetrapolyphosphate | 3 g |
| Sodium sulfite | 20 g |
| Sodium tertiary phosphate (dihydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-β-methanesulfoneamideethyl-3-methyl-4-aminoaniline sulfate | 11 g |
| 2,2-ethylenedithioethanol | 1 g |
| Water added with adjustment of pH 11.70, to make up 1000 ml. | |
| Adjusting solution | |
| Sodium sulfite | 12 g |
| Sodium ethylenediaminetetraacetate (dihydrate) | 8 g |
| Thioglycerine | 0.4 ml |
| Glacial acetic acid | 3 ml |
| Water added with adjustment of pH 6.15, to make up 1000 ml. | |
| Bleaching solution | |
| Sodium ethylenediaminetetraacetate (dihydrate) | 2 g |
| Iron (III) ammonium ethylenediamine-tetraacetate (dihydrate) | 120 g |
| Ammonium bromide | 100 g |
| Water added with adjustment of pH 5.65, to make up 1000 ml. | |

-continued

| | |
|---|---|
| Fixing solution | |
| Ammonium thiosulfate | 80 g |
| Sodium sulfite | 5 g |
| Sodium bisulfite | 5 g |
| Water added with adjustment of pH 6.60, to make up 1000 ml. | |
| Stabilizing solution | |
| Formalin (37% by weight) | 5 ml |
| Konidax (produced by Konica K.K.) | 5 ml |
| Water added with adjustment of pH 7.00, to make up 1000 ml. | |

EXAMPLE 6

The light-sensitive material prepared in the same manner as in Example 4 and Example 5, except for changing the compositions of the first layer and the second layer of the back surface to those shown below, also gave the effect of the present invention.

| | |
|---|---|
| Back surface first layer | |
| IONIC polymer | 0.2 g/m$^2$ |

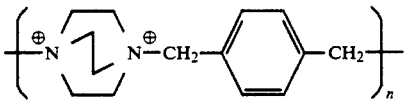

2Cl$^{\ominus}$ (n = 30)

| | |
|---|---|
| Back surface second layer | |
| Diacetylcellulose | 107.6 mg/m$^2$ |
| AEROSIL 200 (grain size about 0.2 μm, silica fine particles) (produced by Nippon AEROSIL K.K.) | 10.8 mg/m$^2$ |
| Citric acid half ethyl ester | 6.4 mg/m$^2$ |

As described in detail above, according to the present invention a light-sensitive silver halide photographic material could be provided, which can be made similar in size by use of a thin support and also local fluctuation in image density can be suppressed.

We claim:

1. A light-sensitive silver halide photographic material substantially resistant to local fluctuations in image density due to the application of pressure, said photographic material comprising a support having a silver halide emulsion layer provided thereon, wherein said support has a thickness of 25 μm to 100 μm, and said silver halide emulsion comprises silver halide grains formed by a fine grain feeding method.

2. The material of claim 1 wherein said support is a film formed of a material selected from the group consisting of cellulose ester, polyamide, polycarbonate, polyester, polystyrene, polypropylene and polyethylene.

3. The material of claim 2 wherein said film is a polyester selected from the group consisting of polyethylene terephthalate, poly-1,4-cyclohexanedimethylene terephthalate and polyethylene-1,2-diphenoxyethane-4,4'-dicarboxylate.

4. The material of claim 3 wherein said polyester film is polyethlene terephthalate film.

5. The material of claim 4 wherein said polyethylene terephthalate film is a biaxially stretched, thermally fixed polyethylene terephthalate film.

6. The material of claim 4 wherein said polyethylene terephthalate film is a copolymerized polyethylene terephthalate film having an aromatic dicarboxylic acid component having a metal sulfonate as a copolymerization component.

7. The material of claim 6 wherein a thickness of said copolymerized polyethylene terephthalate film is 25 to 70 μm.

8. The material of claim 3 wherein said polyester film has a haze of 3% or lower and a water content of 0.5% by weight or more.

9. The material if claim 1 wherein grain size of said silver halide grains is 0.1 μm or less.

10. The material of claim 1 wherein at least 60 percent of the silver halide grains in said silver halide emulsion layer are formed by said fine grain feeding method.

11. The method of claim 1 wherein each of said silver halide grains formed by said fine grain feeding method comprises a solid solution phase containing at least two kinds of halogens, said phase being formed by a fine grain feeding method comprising the feeding of two kinds of silver halide fine grains, wherein one kind of said two kinds of silver halide fine grains consists essentially of silver and one halogen.

12. The material of claim 1 wherein said fine grain feeding method comprises;

introducing silver ions and halide ions into a protective colloid solution, forming silver halide fine grains, storing said silver halide fine grains, and feeding said silver halide fine grains to a reactor to for silver halide grains therefrom.

* * * * *